United States Patent [19]

Karp et al.

[11] 4,120,245

[45] Oct. 17, 1978

[54] LABEL PRINTER

[75] Inventors: Edward C. Karp, Belvidere; Charles Emile De Croix, Woodstock, both of Ill.

[73] Assignee: Sanitary Scale Company, Belvidere, Ill.

[21] Appl. No.: 758,072

[22] Filed: Jan. 10, 1977

[51] Int. Cl.[2] ..... B41J 15/02; B41J 11/08; B41J 11/20

[52] U.S. Cl. ..... 101/288; 242/67.1 R; 242/68; 29/280; 156/384; 101/292; 101/93; 101/316; 400/48; 400/55; 400/614; 400/616.3; 400/618

[58] Field of Search ..... 29/280; 242/67.1 R, 242/68, 67.2; 81/3 R; 101/287, 288, 292, 291, 316, 93.24, 93.25, 93.33, 93.34, 407 BP, 224, 226–228, 269; 197/151, 144, 149, 1 R; 156/584

[56] References Cited

U.S. PATENT DOCUMENTS

| | | | |
|---|---|---|---|
| 1,619,625 | 3/1927 | Merdian | 29/280 |
| 2,689,525 | 9/1954 | Anker et al. | 101/292 |
| 3,092,347 | 6/1963 | Kingsley | 242/67.2 |
| 3,096,712 | 7/1963 | Filsinger | 101/288 |
| 3,110,250 | 11/1963 | Fradkin | 101/93.34 |
| 3,177,803 | 4/1965 | Antonncci | 101/93.34 |
| 3,321,105 | 5/1967 | Marano | 156/584 |
| 3,381,789 | 5/1968 | Hawes | 101/227 |
| 3,610,148 | 10/1971 | Penalnna | 101/269 |
| 3,705,833 | 12/1972 | Wada | 101/292 |
| 3,715,262 | 2/1973 | Kelly | 101/226 |
| 3,721,398 | 3/1973 | Azzalin et al. | 242/68 |
| 3,741,847 | 6/1973 | Sato | 156/384 |
| 3,794,257 | 2/1974 | Reitter | 242/67.1 R |
| 3,967,790 | 7/1976 | Hess | 197/151 |
| 3,999,720 | 12/1976 | Eberlin | 242/68 |
| 4,010,682 | 3/1977 | Hamisch, Jr. | 101/288 |
| 4,024,816 | 5/1977 | Williams et al. | 101/269 |
| 4,039,065 | 8/1977 | Seki et al. | 197/133 R |

*Primary Examiner*—William Pieprz

*Attorney, Agent, or Firm*—Cook, Wetzel & Egan, Ltd.

[57] ABSTRACT

A label printer is described herein for printing on a tape information indicative of the cost of an item. The tape has a top print-receptive layer and a supporting layer and is disposed to be advanced between a printing head and a platen. The printing head is disposed near the tape egress end of the platen, which platen is pivotable at its tape ingress end about an axis perpendicular to the path of tape feed. Platen adjusting means are included at the tape egress end for adjusting the print head working distance. A delaminating bar and a tape advancement wheel are disposed in spaced apart sequence in the path of tape feed and downstream of the tape egress end of said platen so that, as the tape is advanced through the printer, the tape is pulled over the delaminating edge and separates the print-receptive layer from the supporting layer of tape.

7 Claims, 8 Drawing Figures

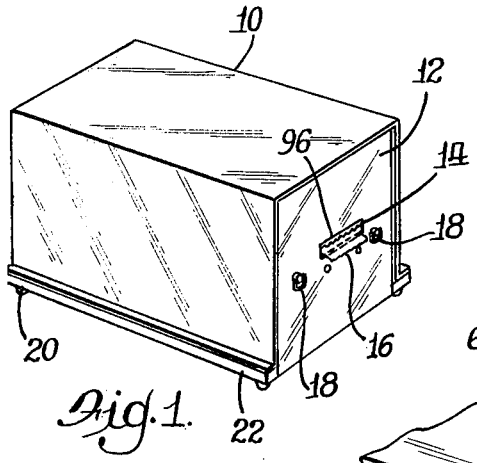
Fig. 1.
Fig. 2.
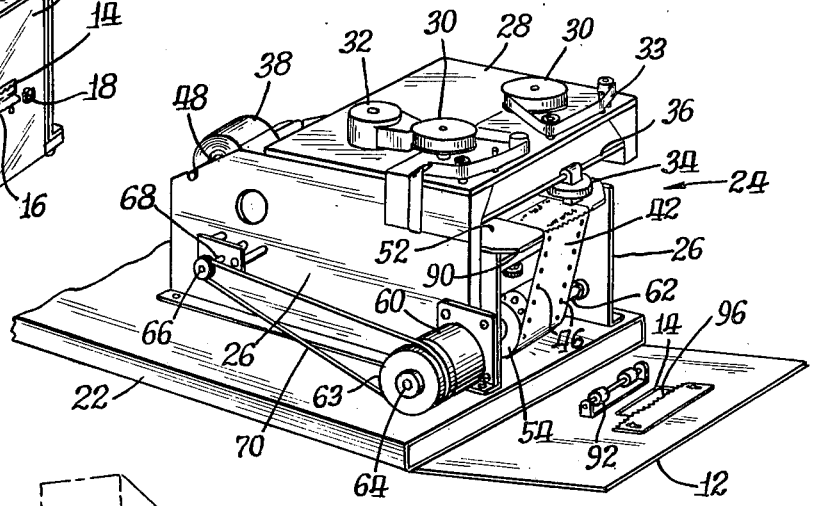
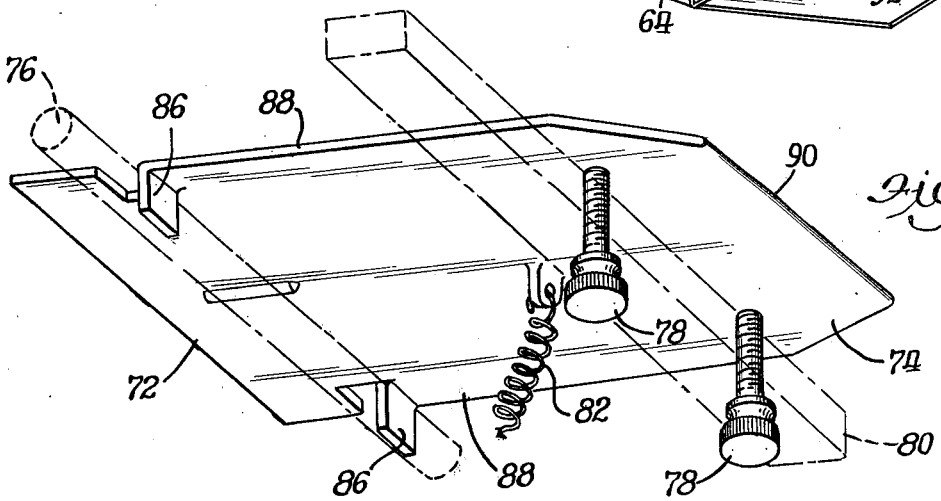
Fig. 3.
Fig. 4.
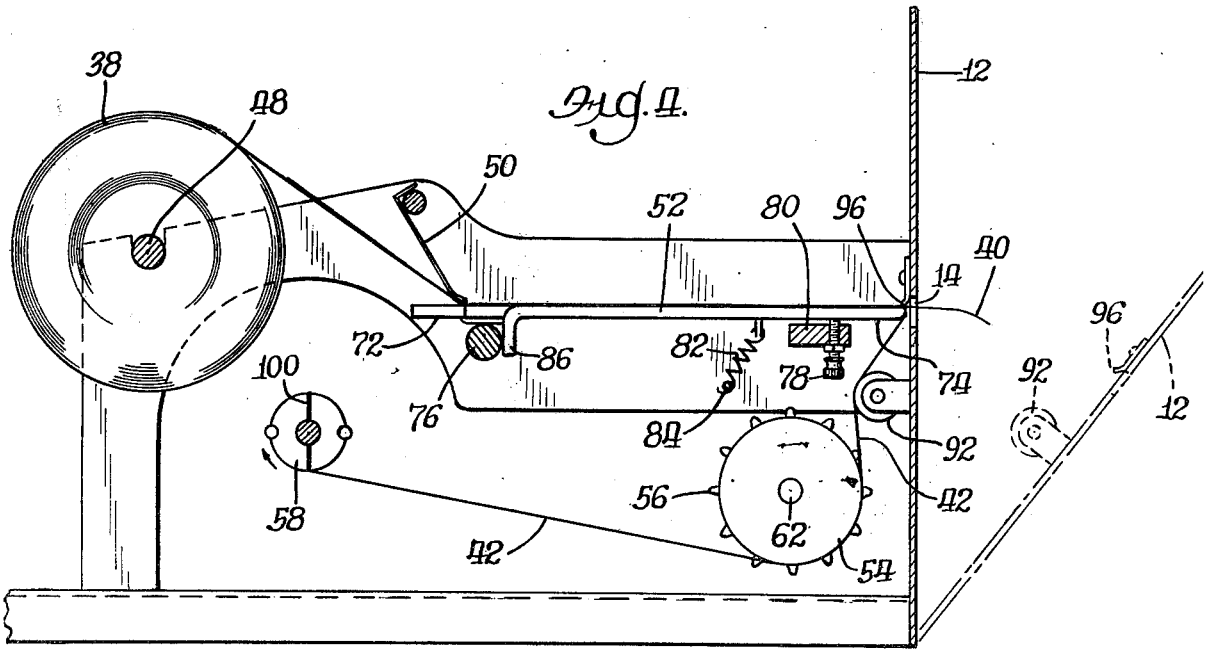

LABEL PRINTER

BACKGROUND OF THE INVENTION

This invention relates to printers for printing indicia on labels and is particularly directed to label printers for printing on labels cost, weight and other information relating to purchased items, which information is provided by associated electronics and an electronic computing scale.

In the past, label printers have been provided for printing on a label weight and price information, for example, derived from an electronic computing scale which weighs a purchased item and calculates the cost of the weighed item. The electronic computing scale is interfaced with the printer so as to cause the printer to print the calculated information on a label.

Some such prior label printers require an undesirably large number of mechanical parts and are therefore costly and subject to wear and breakdown. In addition, such label printers frequently employ a label platen to support the label in alignment with a print head which prints the calculated information on the tape. In the past, such platens have been provided with means for adjusting their position with respect to the print head, but such adjusting means has been undesirably cumbersome and subject to need for readjustment.

Further, many prior label printers have been designed to use label tape having a bottom supporting layer which is removably attached to a top print-receptive layer. For such printers, additional and separate means have been provided (usually a rounded breaker bar) downstream of the platen, to cause separation of the top print receptive layer from the bottom supporting layer. Such separate means then require additional separate and difficult adjustment to maintain an effective spacial and functional relationship with the platen and the print head.

After the print-receptive layer has been imprinted, the bottom supporting layer is detached from the top print-receptive layer and is collected on a take-up spool. When a large amount of the bottom supporting layer has been collected on the take-up spool, it can be difficult to readily remove the collected bottom layer from the take-up spool because of the tightness with which the bottom layer is wound.

An additional problem associated with prior label printers is that their label advancement mechanism, including rollers, sprocket wheels and the like, interferes with the initial manual threading of the label tape through the tape advancement mechanism. This and the above-mentioned problems with prior label printers have made their use and adjustment for use more difficult than is desirable.

Accordingly, it is an object of this invention to provide an improved label printer which avoids the above-described deficiencies associated with prior label printers.

It is a more specific object of this invention to provide a label printer of simple mechanical construction and having a readily adjustable platen.

It is another object of this invention to provide a label printer having a take-up spool adapted for easy removal of collected tape therefrom.

It is yet another object of this invention to provide a label printer whose housing and label advancement mechanism permit easy manual threading of the label tape through the label advancement mechanism.

These and other objects of the invention are more particularly set forth in the following detailed description and in the accompanying drawing of which;

FIG. 1 is a perspective view of a housing for the label printer described herein;

FIG. 2 is a perspective view of the internal printing and tape feeding mechanism of a label printer in accordance with the invention;

FIG. 3 is a perspective view of a platen with an integral, delaminate edge and supporting structure therefore incorporated in the printer shown in FIG. 2;

FIG. 4 is a schematic side elevation view of the tape drive mechanism incorporated in the printer of FIG. 2;

DESCRIPTION OF THE PREFERRED EMBODIMENT

Figure 5:
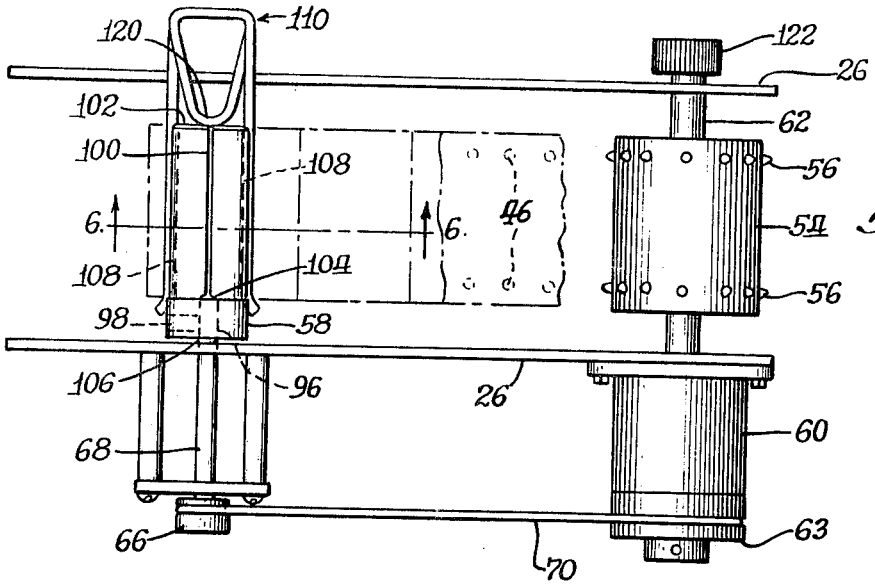
FIG. 5 is a schematic top elevation view of a portion of the tape drive mechanism incorporated in the printer in FIG. 2.

Broadly stated, the label printer described herein includes tape advancement mechanism for advancing a layered tape past a printing head and over a unitary, adjustable platen having an upper tape-supporting surface disposed along the path of the tape feed. The platen has a tape ingress end which is pivotable about an axis perpendicular to the path of the tape feed and a tape egress end which is disposed beneath the printing head, whereby the tape egress end of the platen provides a support for the tape as it passes beneath the printing head and is adapted to be pivotably positioned at a selected working distance from the printing head.

The preferred embodiment also includes improved drive means for advancing the tape past the printing head, an improved tape removal device for facilitating the removal of tape from a take-up spool, and an improved housing for the printer wherein part of the tape advancement mechanism is fixed to a hinged access door so that, upon opening the door, the affixed tape advancement mechanism is swung out of the path to tape feed to thereby facilitate manual threading of new tape through the printer.

Referring now to FIG. 1, there is shown a perspective view of the housing 10 of a label printer embodying various aspects of this invention. The illustrated housing includes an access door 12 in which an elongated aperture 14 is formed and through which a printed tape 16 is ejected. The access door 12 is hinged at its bottom to permit easy access to the interior for manual threading of the tape through the tape feed mechanism. The door 12 is held in the illustrated closed position by a pair of clasps 18.

To permit access to the entire internal printing and tape feeding mechanism, the housing 10 is hinged at its lower rear at 20 so that it may be swung up and away from a base plate 22 which supports the internal parts.

The internal printing and tape advancement mechanism enclosed by the housing 10 may respond to an associated computing scale (not shown) which weighs food items and computes the price of the weighed items. In response to such computation, the label printer described herein prints the computed information, along with other desired information such as the date, on a tape and advances the printed tape out of the printer as shown in FIG. 1. Such an arrangement between a computing scale and a label printer is disclosed in co-pending application Ser. No. 682,083, assigned to the assignee of this invention.

Turning now to a detailed description of the structure of the label printer, reference is made to FIG. 2 wherein the housing 10 has been broken away and the access door 12 is shown in an open position. The label printing mechanism and tape feed mechanism 24 is shown as supported by the base plate 22 and a pair of vertically extending side plates 26. A top plate 28 provides a support for the tape printing mechanism, including a ribbon spool 30 and a motor 32 for advancing a ribbon 33.

A printing head 34 is supported for movement along the axis of a bar 36 extending between the side plates 26. Alternately, a pair of parallel bars similar to bar 36 may support the printing head 34 between the side plates 26. Further details of the printing mechanism are not shown or discussed further because they do not form part of this invention. However, the entire printing assembly, including the printing head 34, the motor 32, and the ribbon spools 30 is available as a unit from Practical Automation, Shelton, Conn., Model No. DMTP-PL-R-1.

Figure 8:
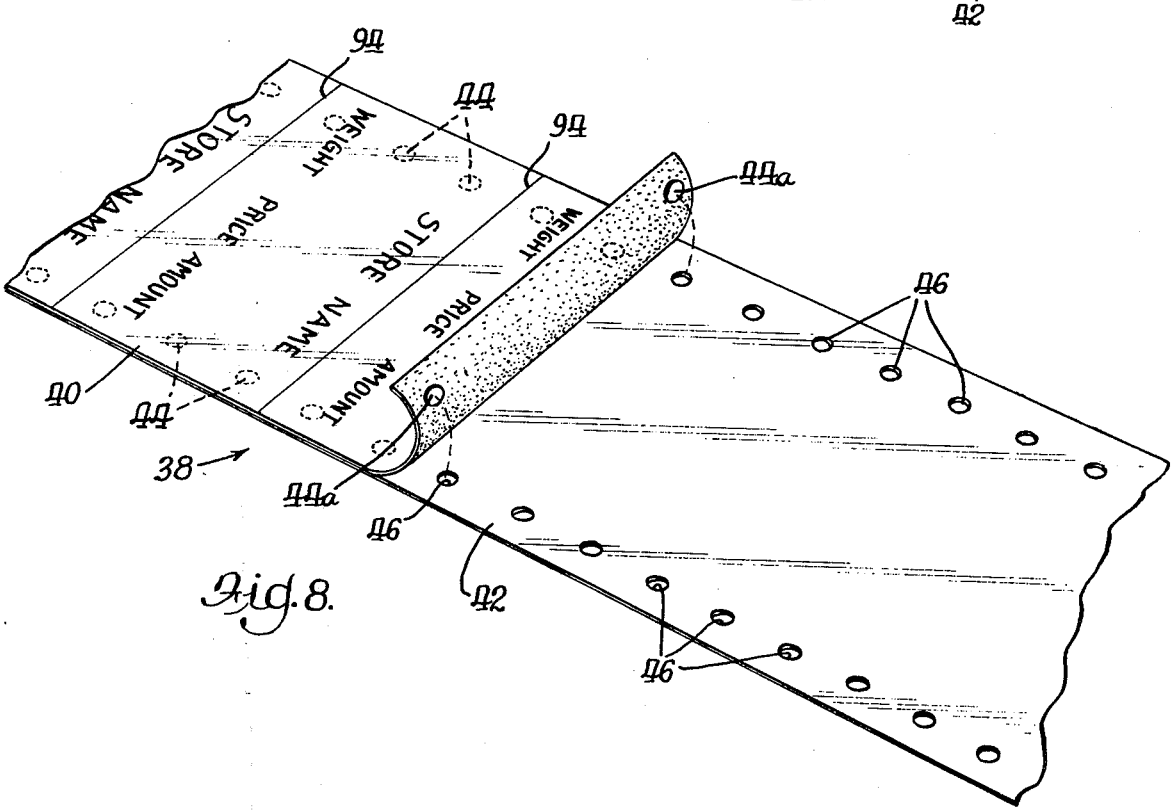
FIG. 8 is a perspective view of a layered tape which may be used with the printer described herein.

The tape advancement mechanism described herein is designed for use with a layered tape having a top print-receptive layer detachably fixed to a bottom supporting layer. Referring to FIG. 8, the composite layered tape 38 may have pre-printed information on the top print-receptive layer 40, such as the store name, etc. The remaining computed information is printed thereon by the printing head 34.

The bottom layer of tape 42 is preferably of a width equal to the width of the top layer 40 and includes circular cut portions or islands 44 disposed along the margins of the bottom layer of tape 42.

The perimeter of each island 44 is preferably completely cut from the main body of the bottom layer 42 so that, when the top layer 40 is removed from the bottom layer 42, the islands will stick to the underside of the top layer 40, as indicated by islands 44*a* in FIG. 8. The resulting holes 46 left in the locations previously filled by the islands 44 serve as indexing holes for engaging a sprocket drive wheel which advances the tape in a manner to be described.

Because the islands 44 underlie the top layer 40 of the tape, the bottom layer 42 need be no wider than the top layer 40. This arrangement is preferable to that employed in many previous printers in which the bottom layer of tape is wider than the top layer, with indexing holes formed along the margin of the bottom layer of tape which extends beyond the edges of the top layer of tape. In the embodiment herein, the excess width of the bottom layer of tape is not needed, thereby decreasing the cost of the tape and rendering the operation of the label printer less expensive.

Turning now to FIGS. 2 and 4, the tape advancement mechanism will be described. Located near the rear of the printer is a tape supply spool 48 upon which is wound a supply of layered tape such as tape 38 of FIG. 8. The tape 38 is fed from the supply spool 48 beneath a spring 50 which urges the tape 38 downwardly onto a unitary, adjustable platen 52 which provides a support for the tape as it passes beneath the printing head 34.

In order to advance the tape past the printing head 34, the bottom layer of tape 42 is threaded over a driven sprocket drive wheel 54 whose sprockets 56 engage the indexing holes 46 (FIG. 8) in the bottom layer of tape. Preferably, the sprocket wheel 54 includes two circumferential rows of sprockets 56 as shown in FIG. 5, the rows of sprockets 56 being axially spaced from each other by a distance which is equal to the distance separating the opposed rows of indexing holes 56 in the bottom layer of tape. When the tape used is of the type shown in FIG. 8 wherein the opposed rows of indexing holes 46 are separated by a distance which is smaller than the width of the top layer of tape, the opposed rows of sprockets 56 will be separated by a corresponding distance which is at least as small as the width of the top layer of tape. However, the label printer herein may also be used with conventional tape having a bottom layer which is wider than a top layer and wherein the indexing holes in the bottom layer of tape are situated along the margins of the bottom layer beyond the edges of the top layer of tape. In that case, the sprockets 56 of the sprocket wheel 54 would be spaced apart by a correspondingly greater distance.

From the sprocket wheel 54, the bottom layer of tape 42 is fed to and wound about a take-up spool 58. To rotate the sprocket wheel 54, a stepping motor 60 (FIG. 2) is mounted on the side plate 26 and connected to the sprocket wheel 54 by a shaft 62 which is journaled in the opposite side wall 26. The stepping motor 60 incrementally rotates the sprocket wheel 54 in synchronism with the printing of the tape, all controlled by associated electronics and a computing scale (not shown).

In order to ensure that the sprocket wheel does not rip the indexing holes 46 in the bottom layer of tape by exerting too much tension thereon, the take-up spool 58 is also driven by the stepping motor 60 to provide additional pull on the bottom layer of tape 42. Toward this end, a drive pulley 63 is mounted on a shaft 64 extending from the stepping motor 60 and a driven pulley 66 is mounted on a shaft 68 which, in turn is coupled to the take-up spool 58. See FIGS. 2 and 5. In order to advance the take-up spool in synchronism with the sprocket wheel 54, an endless drive cable 70 couples the drive pulley 63 to the driven pulley 66. Accordingly, as the stepping motor 60 turns, both the sprocket wheel 54 and the take-up spool 58 turn and share the pulling and advancement of the tape so that the sprockets 56 are not required to impose an undesirable amount of tension on that portion of the bottom layer of tape which they bear on. Thus, the indexing holes 46 in the bottom layer of tape will not rip and thereby cause inaccurate advancement of the tape.

As the tape which is collected on the take-up spool 58 acquires a large diameter, the tension which the take-up spool 58 exerts on the tape may increase to an undesirable level if not otherwise limited. To limit such excess tension, a slip clutch may be employed to limit the tension imparted by the take-up spool. In the illustrated embodiment, the clutch action is effected by choosing the coefficient of friction between the drive cable 70 and the driven pulley 66 to be such that slipping occurs between the drive cable 70 and the driven pulley 66 when the tension on the bottom layer of tape reaches a predetermined value. Thus, the take-up spool 58 will rotate only when the tension exerted on the bottom layer of tape by the take-up spool 58 is below the predetermined value.

The operation of the platen 52 will now be described in greater detail with reference to FIGS. 2, 3 and 4. The platen 52 is shown as having a first or tape ingress end 72 and a second or tape egress end 74 disposed beneath the printing head 34. In order to align the egress end 74 with and at a selected working distance from the printing head 34, the ingress end 72 rests on a pivoting bar 76 for pivoting the platen about the lengthwise axis of the bar 76 and perpendicularly to the path of tape feed. To adjust the height and plane of the egress end 74 of the platen 52, a pair of adjusting screws 78 are threaded through a fixed screw support 80 such that their ends bear on the underside of the egress end 74 of the platen. By turning the screws 78, both the height and the plane of the egress end 74 of the platen are adjusted while the ingress end 72 of the platen pivots about the bar 76.

To hold the platen at a selected vertical position, a spring 82 is attached to the underside of the platen 52 and to a fixed support 84 (FIG. 4) beneath the platen, thereby urging the platen downwardly against the ends of the screws 78 and the bar 76.

To hold the platen in a fixed, substantially horizontal plane, the ingress end 72 of the platen 52 has a pair of downwardly extending tabs 86 which bear on the bar 76. To urge the tabs against the bar 76, the spring 82 extends slightly toward the bar 76 to provide a horizontal force component.

The sides 88 of the platen are held from horizontal motion perpendicular to the path of tape feed by virtue of their being between the upstanding side plates 26 (FIG. 2). Accordingly, the platen 52 is free to move only vertically when adjustment screws 78 are turned.

As pointed out above, the tape used herein includes top and bottom layers which must be separated, the bottom layer being collected on the take-up spool 58 and the top layer being fed out of the printer after being imprinted. To effect the separation or delamination of the bottom layer of tape from the top layer of tape, a delaminating bar is situated in the path of tape feed and downstream of the tape-supporting surface of the platen 52. In the preferred embodiment, the egress end 74 of the platen terminates in a delaminating bar or edge 90 disposed downstream of the printing head 34. As the sprocket wheel 54 and the take-up spool 58 rotate, the bottom layer of tape 42 is drawn downwardly from the platen 52 and across the delaminating edge 90. The upper layer of tape, being somewhat stiff, does not follow the bottom layer of tape but is advanced to the exterior of the printer via the aperture 14 in the access door 12 (FIG. 4), whereupon the ejected top layer of tape may be received by an operator.

Because the delaminating edge 90 is integrally formed with the platen 52, the proper adjustment of the platen height also results in the proper adjustment of the height of the delaminating edge 90. This is superior to prior printers wherein a platen and a delaminating edge are separate structures requiring separate adjustments. Further, the adjustment of the illustrated platen 52 is easier and remains properly adjusted longer than prior platens.

Preferably, the bottom layer of tape is not drawn straight downwardly from the delaminating edge 90; rather, it is caused to change direction by more than 90° to facilitate delamination from the top layer of tape. As shown most clearly in FIG. 4, a roller 92 is attached to the inner side of the access door 12 and is disposed such that, when the access door 12 is closed, the roller 92 is situated between the delaminating edge 90 of the platen and the sprocket wheel 54 so as to bear on the bottom layer of tape 42 and to push the bottom layer of tape inwardly. Two beneficial results obtain. Firstly, the bottom layer of tape is caused to be at an obtuse angle with respect to the delaminating edge 90, i.e., a change of direction of feed greater than 90° is effected. Secondly, the roller 92 effects a greater degree of wrap of the bottom layer of tape around the sprocket wheel 54, thereby creating desirable increased engagement between the bottom layer of tape and the sprocket wheel 54.

An additional advantage of attaching the roller 92 to the access door 12 is that, when the door 12 is opened as indicated in the dashed lines of FIG. 4, the roller 90 is moved out of engagement with the tape and out of the path of tape feed, thereby facilitating threading of the tape along the tape feed path.

As shown in FIG. 8, the top layer of tape 40 may include a set of discrete tape sections separated by die cuts 94 so that the individual tape sections may be ejected one at a time from the printer. However, the top layer of tape may also be continuous, i.e., not cut, in which case a serrated tear bar 96, shown most clearly in FIG. 1, is attached to the access door 12 adjacent the aperture 14. An operator may then tear off a desired length of the tape by pulling it across the tear bar 96.

Figure 6:
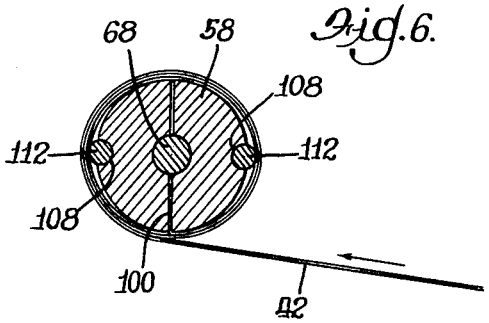
FIG. 6 is a sectional view of a take-up spool as viewed from section line 6 of FIG. 5.

Referring now to FIGS. 5 and 6, there is shown a preferred embodiment of the take-up spool 58 which is designed to make easier the removal of tape therefrom. As shown, the take-up spool 58 is generally cylindrical in shape and is rotatable about the axis of the shaft 68. The shaft 68 extends into a recess 96 in the spool 58 and is held in place by a set screw 98 which projects radially into the spool 58.

In order to positively engage the bottom layer of tape 42 with a spool 58, a tape receiving slot 100 is disposed radially through the spool 58 and extends axially thereof from one end 102 to a point 104 short of the opposite end 106 thereof. The slot 100 receives the end of the bottom layer of tape as shown most clearly in FIG. 6 and the collected tape is wound about the spool 58.

Figure 7:
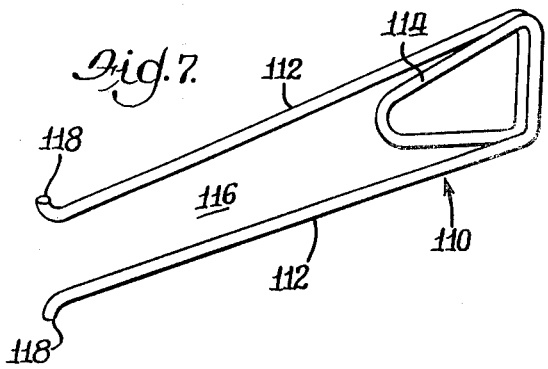
FIG. 7 is a perspective view of a tape removal device for use with the take-up spool illustrated in FIGS. 5 and 6.

A pair of axially extending grooves 108 are formed in the outer surface of the spool 58 for receiving a tape removal device 110, shown most clearly in FIG. 7. The tape removal device 110 is preferably formed of a continuous metal rod, bent as shown in FIG. 7, to form a pair of elongated arms 112. The arms 112 are joined at one end by virtue of a loop 114 and are free at their opposed ends. A spool-receptive space 116 is defined between the arms 112, which arms terminate in tape-engaging fingers 118 extending away from the spool-receptive space 116.

In operation, the end of the bottom layer of tape is first inserted into the slot 100 as shown in FIG. 6. Next, the tape removal device 110 is placed on the spool 58 by sliding the free ends of the arms 112 into the grooves 108 in the spool 58. The spool 58 is thus captured in the spool-receptive space 116 between the arms 112, whereupon the tape is wound around the spool 58 and the arms 112 such that the arms 112 are disposed between the tape and the spool 58. When it is desired to remove the collected tape from the spool, the arms 112 of the tape-removal device are slid out of engagement with grooves 108, whereupon the tape-engaging fingers 118 engage the wound tape and pull it from the spool intact about the arms 112.

Several advantages flow when the tape removal device 110 is constructed as shown in FIG. 7, i.e., made of a single continuous metal rod which is looped. Firstly, the loop 114 acts as a spring which urges the arms 112 toward each other so that when the tape removal device 110 is placed upon the spool 58, the arms 112 are urged into a snug fit into the grooves 108, thereby holding the tape removal device 110 in place. Secondly, the loop 114 has an end 120 which serves a dual purpose, as best illustrated in FIG. 5. As shown therein, the end 120 abuts the end of the spool 58 when the tape removal device 110 is fully engaging the spool 58. Accordingly, an operator need merely slide the tape removal device 110 onto the spool 58 until the end 120 of the loop 114 abuts the spool 58. The end 120 of the loop 114 also serves as a tape restraining member for holding the tape 42 in the slot 100 in the spool 58 to prevent the tape 42 from accidentally sliding axially out of the slot 100.

In order to further facilitate the removal of the bottom layer of tape 42 from the spool 58, it is preferred that the cross-sectional dimensions of the arms 112 be greater than the depth of the grooves 108 so that, upon insertion of the arms 112 into grooves 108, the arms 112 extend above the outer surface area of the spool 58 as shown in FIG. 6. This will insure that when the tape is being wound around the spool 58, the tape will overlap the arms 112 of the tape removal device 110 without substantially bearing on the outer surface area of the spool 58. As a result, there will be less friction between the spool 58 and the tape 42 when the tape 42 is removed from the spool 58 and the removal of the tape will be easier.

To further facilitate removal of the tape 42 from the spool 58, it is preferred that the outer diameter of the spool 58 be continuously tapered axially such that the end of the spool 58 having the smallest outer diameter is disposed to receive the tape removal device 110. Referring to FIG. 5, the end 102 of the spool 58 would have the smallest outer diameter and the opposed end would have the largest outer diameter. Such continual axial tapering of the outer diameter of the spool 58 further facilitates the removal of the bottom layer of the tape 42 from the spool 58.

In initially setting up the described label printer for operation, the platen 52 may first be properly positioned with respect to the print head 34 as described above, i.e., by turning adjustment screws 78. The tape is threaded through the printer by drawing it beneath the spring 50 (FIG. 4) and over the platen 52. A portion of the top layer of tape may then be manually separated from the bottom layer of tape, the latter being drawn around sprocket wheel 54 and the end thereof inserted in the slot 100 (FIG. 6) of the take-up spool 58. Thereafter the tape removal device 110 is engaged with the take-up spool 58 and the tape is manually advanced through the printer by rotating a knob 122 (FIG. 5) which is connected to the sprocket wheel 54 and stepping motor 60 by the shaft 62. Such rotation of the knob 122 causes the drive pulley 63 to rotate, thereby rotating the driven pulley 66 and the take-up spool 58. In this manner, a small amount of tape may be manually wrapped around the take-up spool 58 to insure positive engagement therewith and the top layer of tape may be set at a starting position beneath the print head 34. The printer is then ready for operation.

The embodiment described above provides a label printer superior in several respects to prior label printers. The unitary adjustable platen is simple in construction, is easier to align with the printing head and, once aligned therewith, requires little or no readjustment. The tape advancement mechanism provides reliable engagement with the tape for advancing it in synchronism with the printing of the label and is adapted for use with a less expensive tape than ordinarily used. In addition, the label printer described herein makes removal of a collected bottom layer of tape very easy while the threading of the tape through the tape advancement mechanism is facilitated by virtue of the improved housing in which an access door and an attached roller are easily removed from the path of tape feed to facilitate threading of a new tape.

The various improvements described herein may be incorporated in a label printer individually or together. In any case, improved reliability and/or ease of use results.

While the label printer has been illustrated in a preferred embodiment, it will be obvious to those skilled in the art that many modifications and alterations may be made to the described embodiment without departing from the spirit and scope of the invention. Accordingly,, it is intended that all such modifications and alterations be included within the scope of the appended claims.

What is claimed is:

1. A label printer for printing information on a tape having a print-receptive layer and a supporting layer, said label printer comprising:

a supply spool for the tape;

a unitary, adjustable platen having a tape-supporting surface disposed to receive tape from said supply spool from a tape ingress end to an opposing tape egress end, said tape ingress end resting on a pivoting bar disposed perpendicularly to the path of tape feed for pivoting the platen about the axis of the pivoting bar, and said tape egress end terminating in a delaminating bar;

a printing head disposed above but closely adjacent to the tape egress end of said platen for printing information on the print-receptive layer of tape;

a spring disposed to urge the tape egress end of said platen downwardly away from the printing head;

platen adjusting means including a fixed screw support and a pair of adjustment screws threaded through said screw support such that the ends of said screws bear on said tape egress end of said platen for urging said tape egress end upwardly against the bias of said spring;

tape advancement means disposed downstream of said delaminating bar and engaging the supporting layer of tape for advancing the tape over said platen and delaminating bar;

a take-up spool for the supporting layer of tape; and means for driving said tape advancement means in synchronism with the line printing function of said printing head;

whereby the adjustment of said screws causes said platen to pivot about said pivoting bar to position the tape egress end of the platen relative to the printing head and simultaneously adjust the delaminating bar to its proper height, and the printed upon print-receptive layer of tape is separated from the bottom supporting layer by said delaminating bar.

2. A label printer for printing information on a tape having a print-receptive layer and a supporting layer, said label printer comprising:

a supply spool for the tape;

a unitary, adjustable platen havig a tape-supporting surface disposed to receive tape from said supply spool from a tape ingress end to an opposing tape egress end, said platen being pivotable at said tape ingress end about an axis perpendicular to the path of tape feed;

platen adjusting means for supporting said platen at said tape egress end;

a printing head disposed above but closely adjacent to the tape egress end of said platen for printing information on the print-receptive layer of tape;

a delaminating bar disposed adjacent to the tape egress end of said platen and in the path of tape feed;

tape advancement means disposed downstream of said delaminating bar and engaging the supporting layer of tape for advancing the tape over said platen and delaminating bar;

a take-up spool for the supporting layer of tape, said take-up spool being rotatable about a fixed axis and having a tape receiving slot disposed radially through the axis of rotation of said take-up spool and extending radially from one end thereof to a point short of an opposing end thereof, and having a pair of grooves formed in the outer surface of the take-up spool and extending axially thereof; a tape removal device having a pair of elongated arms free at one end and joined at an opposite end defining a spool receptive space between the arms, the free end of each arm terminating in a tape engaging finger extending away from the spool-receptive space between the arms; and means for driving said tape advancement means in synchronism with the line printing function of said printing head, whereby said platen is adjustable to a selected working distance for the print head by said platen adjusting means, the printed upon print-receptive layer of tape is separated from the bottom supporting layer of said delaminating bar, and upon sliding the free ends of the arms of said tape removal device into the grooves on said take-up spool, the take-up spool is captured in the spool-receptive space between the arms, and upon winding the tape around said arms and said spool, said arms are disposed between the tape and the spool so that said removal device may be disengaged from said take-up spool by sliding its arms out of engagement with the grooves, whereupon the tape engaging fingers engage the wound tape and pull it from the take-up spool intact about the arms of said tape removal device.

3. In a label printer having a printing head for printing information on tape, a supply spool for receiving the tape and for feeding the tape to the printing head, a take-up spool, and means for advancing the tape past the printing head and onto the take-up spool, the improvement comprising:

a cylindrical take-up spool rotatable about a fixed axis and having a tape-receiving slot disposed radially through said spool and extending axially from one end thereof to a point short of an opposite end thereof, and having a pair of axially extending grooves formed in the outer surface of the spool; and a tape removal device having a pair of elongated arms free at one end and joined at an opposed end and defining a spool-receptive space between the arms, the free end of each arm terminating in a tape-engaging finger extending away from the spool-receptive space between the arms, whereby, upon sliding the free ends of the arms of said tape-removal device into the grooves on said take-up spool, the take-up spool is captured in the spool-receptive space between the arms, and upon winding the tape around said arms and said spool, said arms are disposed between the tape and the spool so that said removal device may be disengaged from said takeup spool by sliding its arms out of engagement with the grooves, whereupon the tape-engaging fingers engage the wound tape and pull it from the take-up spool intact about the arms of said tape removal device.

4. The improvement as set forth in claim 3 wherein the elongated arms of said tape removal device are spring biased toward each other, whereby upon engagement of said arms with the grooves of said take-up spool, said arms are urged into a snug fit into said grooves.

5. The improvement as set forth in claim 3 wherein said tape removal device includes a tape-restraining member disposed between said arms for abutment with said take-up spool when said tape removal device is engaged therewith, whereby said tape-restraining member holds the tape from axial movement on said take-up spool.

6. The improvement as set forth in claim 3 wherein the cross-sectional dimensions of the arms of said tape removal device are greater than the depth of the grooves such that, upon insertion of said arms into said grooves, the arms extend above the outer surface area of said take-up spool, whereby, upon the tape being wound around the take-up spool, the tape overlaps the arms of said tape removal device without substantially bearing on the outer surface of said take-up spool, thereby facilitating removal of said tape from said take-up spool.

7. The improvement as set forth in claim 3 wherein said take-up spool has a continuously tapered outer diameter and wherein the end of said spool having the smallest outer diameter is disposed to receive said tape removal device.

* * * * *